US009857079B2

(12) United States Patent
Huber et al.

(10) Patent No.: US 9,857,079 B2
(45) Date of Patent: Jan. 2, 2018

(54) COMBUSTION DEVICE FOR A GAS TURBINE

(71) Applicant: Ansaldo Energia IP UK Limited, London (GB)

(72) Inventors: Andreas Huber, Baden (CH); Nicolas Noiray, Bern (CH); Bruno Schuermans, La Tour de Peilz (CH); Urs Benz, Gipf-Oberfrick (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 459 days.

(21) Appl. No.: 14/623,841

(22) Filed: Feb. 17, 2015

(65) Prior Publication Data

US 2015/0159870 A1 Jun. 11, 2015

Related U.S. Application Data

(62) Division of application No. 13/097,221, filed on Apr. 29, 2011, now Pat. No. 8,991,185.

(30) Foreign Application Priority Data

May 3, 2010 (EP) ..... 10161714

(51) Int. Cl.

| | |
|---|---|
| ***F23R 3/06*** | (2006.01) |
| ***F23R 3/00*** | (2006.01) |
| ***F23M 20/00*** | (2014.01) |

(52) U.S. Cl.

CPC ..... *F23R 3/002* (2013.01); *F23M 20/005* (2015.01); *F23R 2900/00014* (2013.01); *F23R 2900/03041* (2013.01); *F23R 2900/03043* (2013.01)

(58) Field of Classification Search

CPC ..... F23M 20/005; F23R 3/002; F23R 2900/00014; F23R 2900/03041; F23R 2900/03043

See application file for complete search history.

(56) References Cited

U.S. PATENT DOCUMENTS 4,944,362 A 7/1990 Motsinger et al.
5,655,361 A 8/1997 Kishi
(Continued)

FOREIGN PATENT DOCUMENTS

DE 102010016547 A1 1/2011
EP 0990851 A1 4/2000
(Continued)

OTHER PUBLICATIONS

European Search Report for EP Patent App. No. 10161714.0 (dated Nov. 5, 2010).
(Continued)

*Primary Examiner* — Lorne Meade
(74) *Attorney, Agent, or Firm* — Buchanan Ingersoll & Rooney PC

(57) ABSTRACT

A combustion device (1) for a gas turbine includes portions (12) having an inner and an outer wall (13, 14) with an interposed noise absorption plate (15) having a plurality of holes (16). The combustion device (1) further has first passages (17) connecting zones between the inner wall (13) and the plate (15) to the inside of the combustion device (1) and second passages (21) for cooling the inner wall (13). The portions (12) also have an inner layer (22) between the inner wall (13) and the plate (15) defining inner chambers (23), each connected to at least a first passage (17), and an outer layer (24) between the outer wall (14) and the plate (15) defining outer chambers (25) connected to the inner chambers (23) via the holes (16) of the plate (15).

16 Claims, 4 Drawing Sheets

(56) References Cited

U.S. PATENT DOCUMENTS

| | | | | |
|---|---|---|---|---|
| 6,351,947 | B1 | 3/2002 | Keller et al. | |
| 6,640,544 | B2 | 11/2003 | Suenaga et al. | |
| 6,907,736 | B2 | 6/2005 | Ohnishi et al. | |
| 6,981,358 | B2 * | 1/2006 | Bellucci | F23D 11/402 60/39.17 |
| 7,080,514 | B2 * | 7/2006 | Bland | F23M 20/005 181/213 |
| 7,311,175 | B2 | 12/2007 | Proscia et al. | |
| 7,337,875 | B2 * | 3/2008 | Proscia | F02C 7/045 181/210 |
| 7,413,053 | B2 * | 8/2008 | Wasif | F23M 20/005 181/210 |
| 7,448,215 | B2 | 11/2008 | Macquisten et al. | |
| 7,549,290 | B2 | 6/2009 | Holt et al. | |
| 7,832,211 | B2 | 11/2010 | Ikeda et al. | |
| 8,061,141 | B2 | 11/2011 | Johnson et al. | |
| 8,469,141 | B2 | 6/2013 | Wang et al. | |
| 8,490,744 | B2 | 7/2013 | Nakamura et al. | |
| 8,635,874 | B2 * | 1/2014 | Eroglu | F23R 3/002 431/114 |
| 8,720,204 | B2 | 5/2014 | Schilp et al. | |
| 8,727,070 | B2 * | 5/2014 | Huber | F23M 20/005 123/184.55 |
| 8,839,624 | B2 * | 9/2014 | Schnell | F23R 3/002 431/114 |
| 8,931,589 | B2 * | 1/2015 | Bothien | F23M 99/005 181/219 |
| 8,978,382 | B2 * | 3/2015 | Huber | F23R 3/002 431/114 |
| 8,991,185 | B2 * | 3/2015 | Huber | F23R 3/002 431/114 |
| 9,261,058 | B2 * | 2/2016 | Maurer | F23R 3/002 |
| 2005/0034918 | A1 | 2/2005 | Bland et al. | |
| 2005/0284690 | A1 | 12/2005 | Proscia et al. | |
| 2007/0169992 | A1 | 7/2007 | Wasif et al. | |
| 2009/0094985 | A1 | 4/2009 | Johnson et al. | |
| 2011/0048018 | A1 | 3/2011 | Schnell et al. | |
| 2011/0203250 | A1 | 8/2011 | Huber et al. | |

FOREIGN PATENT DOCUMENTS

| | | | |
|---|---|---|---|
| EP | 1605209 | A1 | 12/2005 |
| EP | 1666795 | A1 | 6/2006 |
| EP | 2295864 | A1 | 3/2011 |

OTHER PUBLICATIONS

Search Report for German Patent App. No. 10 2011 016 937.8 (dated Sep. 30, 2011).

* cited by examiner

COMBUSTION DEVICE FOR A GAS TURBINE

This application is a divisional of U.S. application Ser. No. 13/097,221, filed Apr. 29, 2011 which claims priority under 35 U.S.C. §119 to European App. No. No. 10 161 714.0, filed 3 May 2010, the entirety of which are incorporated by reference herein.

BACKGROUND

Field of Endeavor

The present invention relates to a combustion device for a gas turbine. In particular the invention relates to a second combustion device of a sequential combustion gas turbine; sequential combustion gas turbines are known to have two rows of combustion devices, a second row being fed with the flue gases (still containing oxygen) coming from a first row of combustion devices.

The present invention may also be implemented in different combustion devices, such as in combustion devices of the first combustion device row of a sequential combustion gas turbine or in a traditional gas turbine having one single row of combustion devices.

For sake of clarity, simplicity and brevity in the following, specific reference to a combustion device of a second combustion device row of a gas turbine will be made.

Brief Description of the Related Art

During operation of gas turbines, heavy thermo-acoustical pulsations may be generated; these pulsations are very detrimental for the gas turbine lifetime (they can cause mechanical and thermal damages) and may also limit the operating regime; thus thermo-acoustical pulsations must be suppressed.

In particular, gas turbines operating with lean premixed, low emission combustion devices exhibit a high risk of unstable combustion that may cause these thermo-acoustical pulsations.

Traditionally, in order to suppress thermo-acoustical pulsations, damping devices connected to the combustion device are provided; examples of such damping devices are quarter wave tubes, Helmholtz dampers, or acoustic screens.

U.S. Patent Application Pub. No. 2005/0229581 discloses a combustion device having an inner and an outer perforated, spaced apart, parallel walls, with the volume between these walls that defines a plurality of Helmholtz dampers (thanks to the holes in the inner wall).

Cooling is a major problem in this structure and is achieved by impingement cooling, by air that, passing through the perforated outer wall, impinges on the perforated inner wall, to then enter the combustion device via the perforated inner wall.

U.S. Pat. No. 6,351,947 discloses a similar combustion device having an additional noise absorbing perforated plate between the spaced apart inner and outer wall, to increase damping effectiveness and frequency bandwidth.

Nevertheless, these combustion devices have a number of drawbacks.

In fact, in order to cool the outer and the inner wall (that delimits the inside of the combustion device), a large amount of air must be diverted through the holes of the outer wall into the space between the inner and outer wall.

This reduces the damping efficiency and, since this air does not take part in the combustion, the flame temperature and consequently the $NO_x$ emissions are higher than what is theoretically possible.

This drawback is even greater in the combustion devices having the noise absorbing perforated plate between the inner and the outer wall, since air (that is supplied via holes in the outer wall) cannot directly reach and impinge on the inner wall.

In addition, poor cooling may cause the temperature inside of the space between the inner and outer wall to rise, leading to an increase of the speed of the sound and thus shifting the damping frequency to a frequency different from the design frequency.

SUMMARY

One of numerous aspects of the present invention includes a combustion device by which the said problems of the known art can be addressed.

Another aspect includes a combustion device in which a limited amount of air is diverted for cooling the inner and outer wall.

A further aspect of the invention includes a combustion device with a high damping efficiency and low $NO_x$ emissions.

Another aspect of the invention includes a combustion device in which, during operation, no damping frequency switching or a limited damping frequency switching, practically not affecting the design damping efficiency, occurs.

Advantageously, a large bandwidth frequency may be damped.

BRIEF DESCRIPTION OF THE DRAWINGS

Further characteristics and advantages of the invention will be more apparent from the description of a preferred but non-exclusive embodiment of the combustion device according to the invention, illustrated by way of non-limiting example in the accompanying drawings, in which:

FIG. 7 illustrates a cross-sectional view taken along line VII-VII shown in FIG. 6.

DETAILED DESCRIPTION OF EXEMPLARY EMBODIMENTS

With reference to the figures, a combustion device for a gas turbine, generally indicated by the reference number 1, is illustrated.

Figure 1:
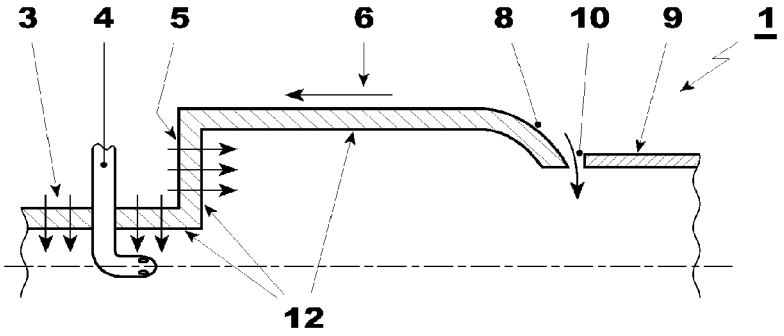
FIG. 1 is a schematic longitudinal section of a combustion device.

The combustion device 1 is a first or a second combustion device of a sequential combustion gas turbine or also a combustion device of a traditional gas turbine having one single row of combustion devices; in the following, only reference to the second combustion device of a sequential combustion gas turbine is made and, in this respect, FIG. 1 shows such a second combustion device of a sequential combustion gas turbine having a mixing chamber 3 wherein an oxidizer, e.g., the flue gas still containing oxygen coming from a first combustion device, is introduced through an inlet (not shown).

The mixing chamber 3 is provided with a transversal lance 4 for injecting a fuel to be mixed with the oxidizer and combusted.

Downstream of the mixing chamber 3, the combustion device 1 has a front plate 5 and a combustion chamber 6 having a downstream convergent shape 8; the combustion chamber 6 is separated from a turbine 9 by a gap 10 through which purge air is injected.

The combustion device 1 includes at least a portion 12 having an inner and an outer wall 13, 14 with an interposed noise absorption plate 15 having a plurality of holes 16. Advantageously, the holes 16 increase the damping efficiency.

In particular, the portion 12 may be located at the wall of the mixing chamber 3 or a portion thereof, and/or at the wall of the front plate 5 or a portion thereof, and/or at the wall of the combustion chamber 6 or a portion thereof.

The portion 12 further has first passages 17 connecting zones between the inner wall 13 and the plate 15 to the inside 18 of the combustion device 1, and second passages 21 for cooling the inner wall 13.

The portion 12 includes an inner layer 22 between the inner wall 13 and the plate 15 defining inner chambers 23, each connected to at least a first passage 17.

In addition, the portion 12 also includes an outer layer 24 between the outer wall 14 and the plate 15 defining outer chambers 25 connected to the inner chambers 23 via the holes 16 of the plate 15.

In the following, particular reference to each of the embodiments respectively shown in figures is made.

Figure 2:
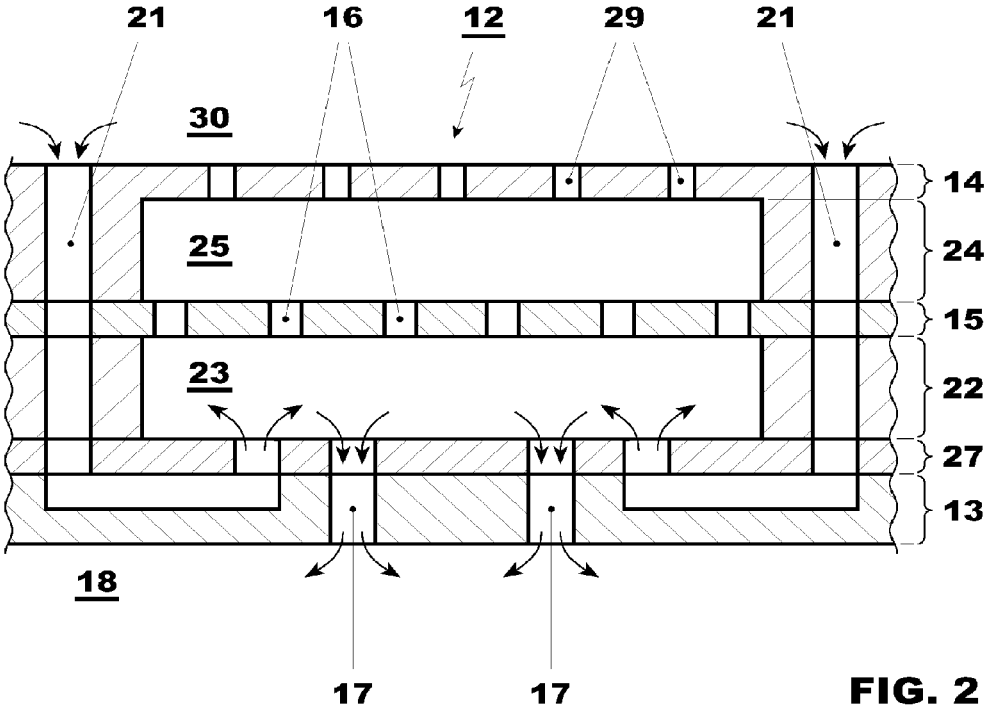
FIGS. 2, 3, 4, 5 are cross sections of different embodiments of the invention.

In the embodiment of FIG. 2, the portion 12 has the inner wall 13, an additional layer 27, the inner layer 22 and the plate 15 that lie one over the other; in addition, on the plate 15 the outer layer 24 and outer wall 14, that are manufactured in one piece, are connected.

All these layers define a layered structure whose elements are preferably brazed together (in any case different connections are possible, such as screws).

Other embodiments are possible and, for example, a further layer may be provided between the inner wall 13 and the layer 27, to define the portion of second passages 17 opening into the chambers 23 (example not shown). In addition the outer layer 24 and outer wall 14 may be formed as separate pieces. In this embodiment, each of the inner wall 13, further layer, layers 27, 22, plate 15, layer 24, and outer wall 14 is defined by one plate, such that manufacturing is easy, since the first and second passages 17, 21 and the chambers 23, 25 are defined by through apertures (such as holes or millings) in the corresponding plate.

Further configurations are also possible, they are not described in detail because they are implicit from what already described; naturally the particular configuration is to be chosen according to the particular needs.

In any case, the inner layer 22 is preferably made in a separate piece from the inner wall 13 and the outer layer 24 is made in one piece with or in a separate piece from the outer wall 14.

Advantageously, the outer wall 14 has a plurality of holes 29 connecting a plenum 30 housing the combustion device 1 to the outer chambers 25. This lets cooling of the chambers 23, 25 be increased, without the need of supplying a too large amount of air via the second passages 21 into the chamber 23 and 25.

In this embodiment, each chamber 23 is connected to two first passages 17 defined by through apertures (through holes) in the layer 27 and inner wall 13.

The second passages 21 open in the plenum 30 and pass through the layered structure.

In this respect the second passages 21 are defined by aligned through apertures (holes) formed in the outer wall 14, outer layer 24, plate 15, inner layer 22, and layer 27; in addition, the second passages 21 also have a portion, parallel to the inner wall 13 and opening in the inner chamber 23, defined by a blind aperture (milling) extending in the inner wall 13.

It is also clear that the first and the second passages 17, 21 may also be in a different number.

Figure 3:
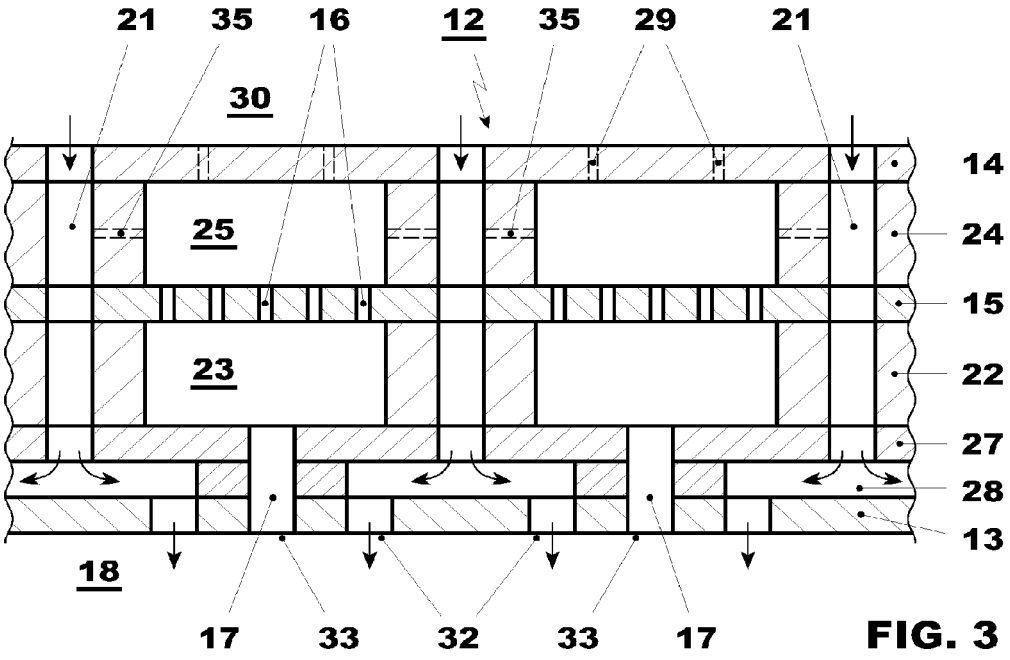

FIG. 3 shows a further embodiment of the combustion device; in this embodiment like references indicate like elements.

The portions 12 of this embodiment are similar to those of FIG. 2 and include the inner wall 13, two additional layers 27, 28, the inner layer 22, the plate 15, the outer layer 24, and the outer wall 14 that lie one over the other to define a layered structure whose pieces are preferably brazed together (also in this case further connections, such as screws, are possible).

Even if each wall 13, 14 and layers 22, 24, 27, 28 and plate 15 are shown each defined by one piece, in different embodiments one or both of the walls may be formed as one piece with the adjacent layers and/or adjacent layers may be formed as one piece according to the particular needs.

In this embodiment each inner chamber 23 is connected to one first passage 17; the second passages 21 do not open into the inner chamber 23 like in the embodiment of FIG. 2, but they open in the inside 18 of the combustion device 1.

In particular, the outlets 32 of the second passages 21 partly or completely encircle inlets 33 of the first passages 17 (FIG. 3). This lets the inlets 33 of the first passages 17 be cooled and detuning be hindered.

Also in this case the number of first passages 17 may be chosen according to the needs.

A further embodiment (not shown) deriving from the combination of the embodiments shown in FIGS. 2 and 3 is possible; this embodiment has the second passages 21 arranged to partly supply air into the inner chamber 23 (like the embodiment of FIG. 2) and partly to supply air into the inside 18 of the combustion device 1 (like the embodiment of FIG. 3).

In addition, FIG. 3 also shows (in dashed line) holes 35 that could be provided between the second passages 21 and the outer chambers 25 (and/or inner chambers 23) to increase the bandwidth and damping efficiency.

Figure 4:
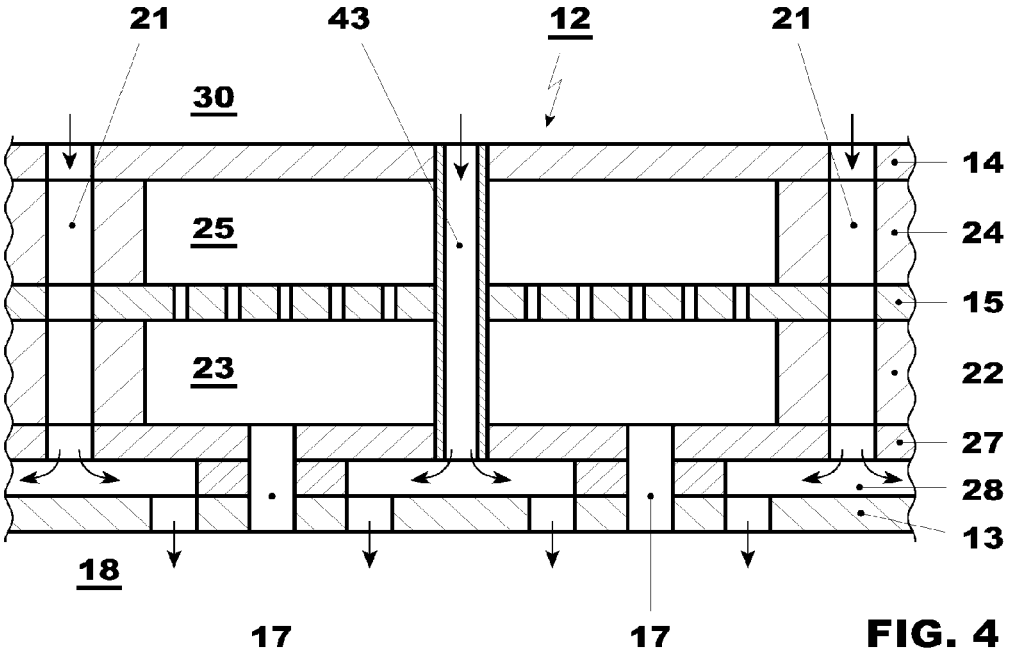

FIG. 4 shows an even further embodiment of the invention; this embodiment is similar to the embodiment shown in FIG. 3.

In particular this embodiment has a plurality of first passages 17 connected to each inner chamber 23 and second passages 21 opening in the inside 18 of the combustion device 1 and having the same structure as those already described with reference to FIG. 3.

Moreover, additional second passages, defined by pipes 43 and apertures in the layer 28 and inner wall 13 are provided, for increasing cooling of the inner wall 13.

These pipes 43 have one end opening in the plenum 30 and the other end facing the inner wall 13 to impinge cooling it.

Also in this case the number of first passages may be different according to the needs.

Figure 5:
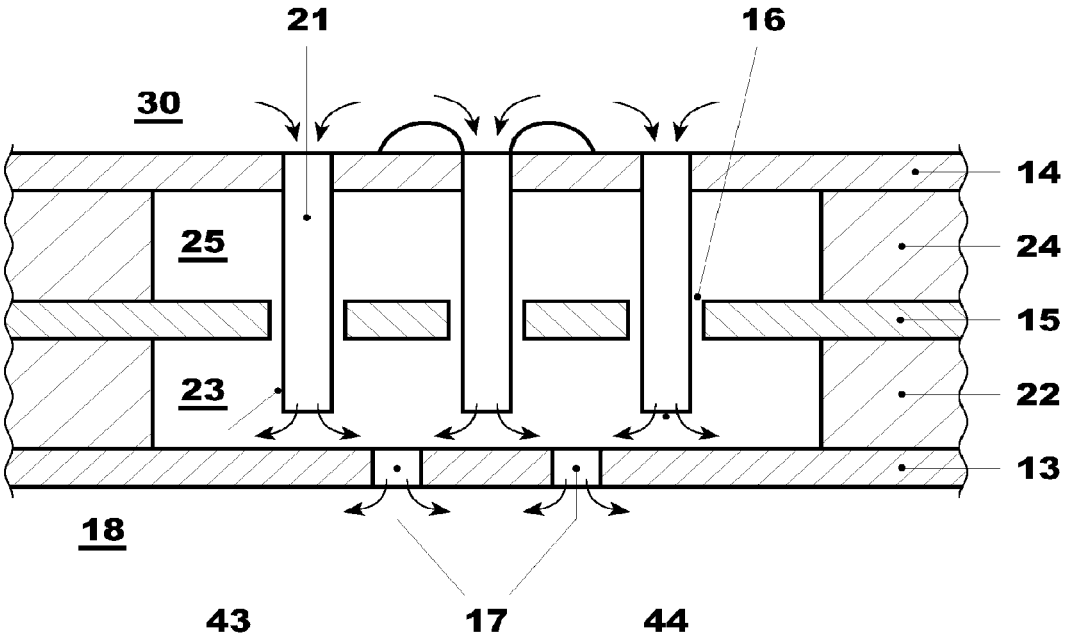

A further embodiment of the invention is shown in FIG. 5.

In this embodiment the portions 12 have the inner wall 13, inner layer 22, plate 15, outer layer 24, and outer wall 14 that lie one over the other to define a layered structure whose pieces are preferably brazed together (also in this case different connections such as screws are possible).

In addition, each of the walls 13, 14, plate 15 and layers 22, 24 is made in one piece; naturally different embodiments are possible and for example the inner wall 13 and the inner layer 22 may be formed as one piece and/or the outer wall 14 and the outer layer 24 may also be formed as one piece.

In this embodiment each inner chamber 23 is connected to two first passages 17, naturally a different number of first passages 17 may be provided according to the needs.

The second passages 21 are defined by pipes 43 (similarly to those described with reference to FIG. 4), with inlet openings in the plenum 30 and outlets 44 facing the inner wall 13, within the inner chamber 23, to impinge cooling it.

As shown in the figures, a number of pipes 43 passes through the inner and outer chambers 23, 25; in the drawings three pipes 43 in each inner and outer chamber 23, 25 are shown, even if their number may be different.

The plate 15 defines the holes 16 together with the pipes 43, to increase damping of the pulsations.

Figure 6:
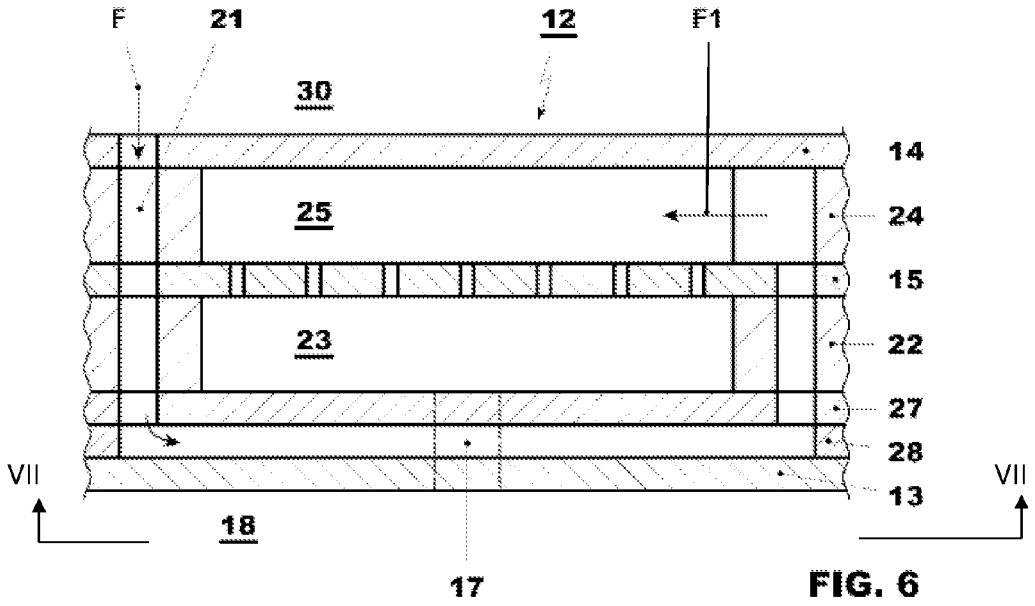
FIGS. 6, 7 show a further embodiment of the invention.
Figure 7:
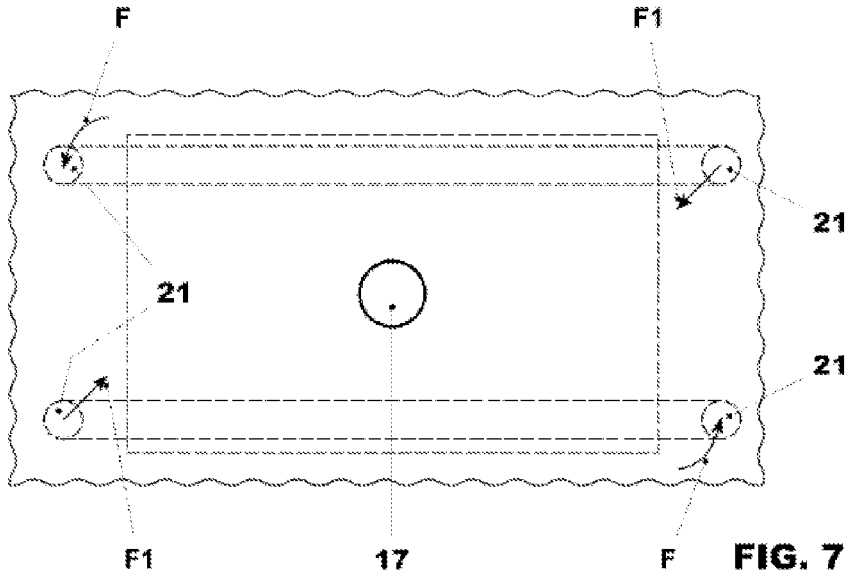

FIGS. 6 and 7 shows a further embodiment of the invention, in which a second passage 21 passes beside a chamber 25, then it passes close to the chamber 23 (between the chamber 23 and the inside of the combustion chamber 18) and then again beside the chamber 25 (at the other side) to open into it.

In particular the arrows F indicate the air entering the second passage 21 and the arrows F1 the air entering the chamber 25 from the second passage 21.

The operation of the combustion device in the different embodiments of the invention is substantially the same and is the following.

The inner and outer chambers 23 and 25 with first passages 17 define Helmholtz dampers, which damp pressure oscillations generated during operation.

The plate 15 allows a very large bandwidth to be damped and the pressure oscillations to be intensely damped, since in addition to oscillating in the first passage 17, gas may also oscillate between the first and the second chamber 23, 25 via the holes 16.

In addition to this feature, all combustion device embodiments described herein let the inner wall 13 be intensely cooled, since cooling air from the plenum 30 is conveyed (via the second passages 21) through the layered structure and to the inner wall 13. This advantageously allows the amount of air diverted from the plenum 30 for cooling to be limited (less than in traditional combustion devices) such that damping frequency is increased and NO emissions are reduced.

Moreover, thanks to the improved cooling no or only a limited frequency switch occurs.

Naturally the features described may be independently provided from one another.

In practice the materials used and the dimensions can be chosen at will according to requirements and to the state of the art.

REFERENCE NUMBERS

1 combustion device
3 mixing chamber
4 lance
5 front plate
6 combustion chamber
8 convergent shape
9 turbine
10 gap
12 portion
13 inner wall
14 outer wall
15 noise absorption plate
16 holes of 15
17 first passages
18 inner of 1
21 second passages
22 inner layer
23 inner chamber
24 outer layer
25 outer chamber
27 additional layer
28 additional layer
29 holes of 14
30 plenum
32 outlets of 21
33 inlets of 17
35 holes
43 pipe
44 outlet of 43
Fair entering 21
F1 air entering 25

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A combustion device for a gas turbine comprising:

a portion having an inner wall and an outer wall and an interposed noise absorption plate having a plurality of holes through the noise absorption plate, a plurality of inner chambers located between the inner wall and the noise absorption plate, the inner wall delimiting an inside of the combustion device;

a plurality of first passages connecting the plurality of inner chambers to the inside of the combustion device;

a plurality of second passages extending in the inner wall, the plurality of second passages configured and arranged to cool the inner wall, wherein each one of the plurality of second passages extend through the outer wall to the inner wall and open into the inside of the combustion device;

an inner layer between the inner wall and the plate defining the plurality of inner chambers, each one the plurality of inner chambers connected to at least one of the plurality of first passages; and an outer layer between the outer wall and the plate defining a plurality of outer chambers, each one of the plurality of outer chambers connected to a respective one of the plurality of inner chambers via the plurality of holes, wherein the plurality of inner chambers, the plurality of outer chambers, and the plurality of first passages define Helmholtz dampers.

2. The combustion device as claimed in claim 1, wherein said inner wall, said inner layer, said noise absorption plate, said outer layer, and said outer wall lay one over the other to define a layered structure.

3. The combustion device as claimed in claim 2, wherein said inner wall, said inner layer, said noise absorption plate, said outer layer, and said outer wall are brazed together.

4. The combustion device as claimed in claim 2, wherein the inner layer is a separate piece from the inner wall.

5. The combustion device as claimed in claim 2, wherein the outer layer is integral with or a separate piece from the outer wall.

6. The combustion device as claimed in claim 2, wherein the outer wall delimits an outside of the combustion device and has a plurality of outer holes connecting said outside to the plurality of outer chambers.

7. The combustion device as claimed in claim 2, wherein: the outer wall delimits an outside of the combustion device; and each one of the plurality of second passages open to said outside and pass through the layered structure.

8. The combustion device as claimed in claim 7, further comprising:

a plurality of aligned apertures formed at least in said outer wall, said outer layer, said noise absorption plate, and said inner layer; wherein the plurality of aligned apertures at least partly define each one of the plurality of second passages.

9. The combustion device as claimed in claim 8, wherein each one of the plurality of second passages comprise a portion extending parallel to the inner wall.

10. The combustion device as claimed in claim 9, wherein said portion of each one of the plurality of second passages extending parallel to the inner wall is adjacent to and is configured and arranged to cool the inner wall.

11. The combustion device as claimed in claim 1, further comprising:

a plurality of pipes, each one of the plurality of pipes having an outlet facing the inner wall; and wherein at least some of the plurality of second passages are at least partly defined by one of the plurality of pipes.

12. The combustion device as claimed in claim 1, wherein:

each one of the plurality of first passages comprise an inlet in said inner wall; and each one of the plurality of second passages comprise an outlet in said inner wall, the inlet of each one of the plurality of first passages being at least partially encircled by respective outlets of the plurality of second passages.

13. The combustion device as claimed in claim 1, wherein each one of the plurality of second passages includes a portion extending in and parallel to the inner wall.

14. A combustion device for a gas turbine comprising:

a portion having an inner wall and an outer wall and an interposed noise absorption plate having a plurality of holes through the noise absorption plate, a plurality of inner chambers located between the inner wall and the noise absorption plate, the inner wall delimiting an inside of the combustion device;

a plurality of first passages connecting the plurality of inner chambers to the inside of the combustion device;

a plurality of second passages extending in the inner wall, the plurality of second passages configured and arranged to cool the inner wall, wherein each one of the plurality of second passages open into the inside of the combustion device;

an inner layer between the inner wall and the plate defining the plurality of inner chambers, each one the plurality of inner chambers connected to at least one of the plurality of first passages;

an outer layer between the outer wall and the plate defining a plurality of outer chambers, each one of the plurality of outer chambers connected to a respective one of the plurality of inner chambers via the plurality of holes; and a plurality of aligned apertures formed at least in said outer wall, said outer layer, said noise absorption plate, and said inner layer, wherein the plurality of aligned apertures at least partly define each one of the plurality of second passages, wherein:

the outer wall delimits an outside of the combustion device; said inner wall, said inner layer, said noise absorption plate, said outer layer, and said outer wall lay one over the other to define a layered structure;

each one of the plurality of second passages open to said outside and pass through the layered structure, and the plurality of inner chambers, the plurality of outer chambers, and the plurality of first passages define Helmholtz dampers.

15. The combustion device as claimed in claim 14, wherein:

each one of the plurality of first passages comprise an inlet in said inner wall; and each one of the plurality of second passages comprise an outlet in said inner wall, the inlet of each one of the plurality of first passages being at least partially encircled by respective outlets of the plurality of second passages.

16. A combustion device for a gas turbine comprising:

a portion having an inner wall and an outer wall and an interposed noise absorption plate having a plurality of holes through the noise absorption plate, a plurality of inner chambers located between the inner wall and the noise absorption plate, the inner wall delimiting an inside of the combustion device;

a plurality of first passages connecting the plurality of inner chambers to the inside of the combustion device;

a plurality of second passages extending in the inner wall, the plurality of second passages configured and arranged to cool the inner wall, wherein each one of the plurality of second passages open into the inside of the combustion device;

an inner layer between the inner wall and the plate defining the plurality of inner chambers, each one the plurality of inner chambers connected to at least one of the plurality of first passages;

an outer layer between the outer wall and the plate defining a plurality of outer chambers, each one of the plurality of outer chambers connected to a respective one of the plurality of inner chambers via the plurality of holes;

a plurality of pipes, each one of the plurality of pipes having an outlet facing the inner wall, at least some of the plurality of second passages being at least partly defined by one of the plurality of pipes;

wherein said inner wall, said inner layer, said noise absorption plate, said outer layer, and said outer wall lay one over the other to define a layered structure; and wherein the outer wall delimits an outside of the combustion device and each one of the plurality of second passages open to said outside and pass through the layered structure, and the plurality of inner chambers, the plurality of outer chambers, and the plurality of first passages define Helmholtz dampers.

* * * * *